United States Patent [19]

Iiyama et al.

[11] Patent Number: 4,663,641

[45] Date of Patent: May 5, 1987

[54] TWO-COLOR THERMOSENSITIVE RECORDING ADHESIVE LABEL

[75] Inventors: Kiyotaka Iiyama, Mishima; Norihiko Inaba, Numazu, both of Japan

[73] Assignee: Ricoh Company, Ltd., Tokyo, Japan

[21] Appl. No.: 839,931

[22] Filed: Mar. 17, 1986

[30] Foreign Application Priority Data

Mar. 28, 1985 [JP] Japan ..... 60-64894

[51] Int. Cl.[4] ..... B41M 5/18

[52] U.S. Cl. ..... 346/204; 346/200; 346/205; 346/226; 427/152

[58] Field of Search ..... 346/200, 204, 205, 206, 346/226; 427/150, 151, 152

[56] References Cited

U.S. PATENT DOCUMENTS

| | | | |
|---|---|---|---|
| 4,020,232 | 4/1977 | Kohmura et al. | 346/205 |
| 4,125,636 | 11/1978 | Kamio et al. | 346/205 |
| 4,172,727 | 10/1979 | Miyamoto et al. | 346/205 |
| 4,613,878 | 9/1986 | Inaba et al. | 427/152 |

FOREIGN PATENT DOCUMENTS

| | | | |
|---|---|---|---|
| 0047843 | 4/1978 | Japan | 346/204 |
| 0040588 | 4/1981 | Japan | 346/204 |
| 0054597 | 3/1984 | Japan | 346/204 |
| 0068991 | 4/1985 | Japan | 346/204 |

*Primary Examiner*—Bruce H. Hess

*Attorney, Agent, or Firm*—Oblon, Fisher, Spivak, McClelland, & Maier

[57] ABSTRACT

A two-color thermosensitive recording adhesive label comprising a support material, a first lower thermosensitive coloring layer and a second upper thermosensitive coloring layer supported on the support material, capable of yielding two different colors, with the coloring temperature for the second thermosensitive coloring layer being lower than that for the first thermosensitive coloring layer, in which at least the second thermosensitive coloring layer contains a basic leuco dye and a color developer capable of inducing color formation in the leuco dye upon application of thermal energy, and a decolorizing agent for decoloring the color developed in the second thermosensitive coloring layer at the time of color development of the first thermosensitive coloring layer is contained in the first thermosensitive coloring layer or in a decolorizing intermediate layer interposed between the first thermosensitive coloring layer and the second thermosensitive layers, which decolorizing agent is selected from particular piperazine derivatives and a compound having three or more amide groups and a compound having two or more amide groups and one or more tertiary amine groups as defined in the claims.

18 Claims, No Drawings

TWO-COLOR THERMOSENSITIVE RECORDING ADHESIVE LABEL

BACKGROUND OF THE INVENTION

The present invention relates to a two-color thermosensitive recording adhesive label and more particularly to a two-color thermosensitive recording adhesive label comprising a support material, two thermosensitive coloring layers successively formed on one side of the support material, each coloring layer being capable of yielding a different color by application of a different quantity of thermal energy thereto, an adhesive layer formed on the other side of the support material, opposite to the thermosensitive coloring layers, and a disposable backing sheet which is attached to the adhesive layer and can be peeled off the adhesive layer when the thermosensitive recording adhesive label is used.

A conventional thermosensitive recording material comprises a support material such as a sheet of paper and a thermosensitive coloring layer formed on the support material, on which thermosensitive coloring layer colored images can be formed by application of heat thereto. For image formation by application of heat, a thermal printer provided with a thermal head is in general use. In such a conventional thermosensitive recording material, there are usually employed in the thermosensitive coloring layer a colorless or light-colored leuco dye containing a lactone ring, a lactam ring or a spiropyran ring, and a color developer which induces color formation in the leuco dye upon application of heat by the reaction with the leuco dye, since it is capable of yielding clear images with minimized fogging.

Because of the capability of forming colored images by simple application of heat, such thermosensitive recording materials are widely used, not only for copying books and documents, but also for recording output information from computers, facsimile apparatus, telex and other information transmission and measuring instruments. Conventionally, the color of the images developed in the thermosensitive recording materials is mostly a mono color such as blue and black. Depending upon the recording mode, it will be more convenient if it is allowed to record particular data in a different color from the remainder on a thermosensitive recording material in order to display the particular data more distinctly from the remainder.

Recently, many trials have been made to attain recording with multiple colors by applying heat at different temperatures or by applying different quantities of thermal energy. Accordingly, a variety of multi-color thermosensitive recording sheets have been proposed.

A conventional multi-color thermosensitive recording sheet comprises a support material and two thermosensitive color-forming layers overlaying the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms a color at a low temperature, while the high-temperature color-forming layer does not form a color at all at the low temperature, but forms a color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color already developed in a low-temperature color-forming layer, so that a different color from the color in the low-temperature layer is produced in the high-temperature color-forming layer.

In the other type, when the high-temperature color-forming layer is colored, the color in the low-temperature color-forming layer is decolorized by a decolorizing agent, so that only the high-temperature color-forming layer is colored without the mixing of the color of the low-temperature color-forming layer and the color of the high-temperature color-forming layer.

Specific examples of the former type are disclosed, for instance, in Japanese Patent Publications Nos. 49-69, 49-4342 and 49-27708, Japanese Laid-Open Patent Applications No. 48-86543 and No. 49-65239.

Specific examples of the latter type are disclosed, for instance, in Japanese Patent Publications Nos. 50-17865, 50-17866, 51-29024, 51-87542, 54-36864 and 55-36519.

The former type has the shortcoming that the practically developable color systems are limited to such combinations that the color developed at high temperature can overcome the color developed at low temperature, such as red (low temperature) - black (high temperature), and blue (low temperature) - black (high temperature).

In the latter type, there are no particular limitations to the combination of colors. However, a decolorizing agent capable of completely decolorizing the color developed in the low-temperature coloring color-forming layer (when developing a color in the high temperature color-forming layer) has not been discovered, so that the separation of the color in the high temperature color-forming layer from the color in the low temperature color-forming layer is incomplete. The result is that the color developed in the low temperature color-forming layer spreads and overlaps the color developed in the high temperature color-forming layer. In order to avoid such problem, the following compounds are disclosed in Japanese Patent Publication No. 51-19992: acetamide, stearamide, phthalonitrile, m-nitroaniline and β-naphthylamine. Of these compounds, stearamide and phthalonitrile are generally employed as sensitizer agent and their decolorizing effect is slight. By contrast, m-nitroaniline and β-naphthylamine have relatively high decolorizing effect. However, they are apt to be decomposed to become yellowish in color and are highly soluble in water. Therefore, the images developed in the low temperature color-forming layer are easily decolored by m-nitroaniline and β-naphthylamine. Furthermore, they are highly toxic and absorbed through skin, causing eye and skin irritations. Therefore the contact with skin, eyes and clothing must be avoided. In this sense, they are not suitable for use in practice.

In Japanese Patent Publication No. 54-36864, quaternary ammonium salts (amine derivatives) are proposed as decolorizing agent. However, the quaternary ammonium salts are highly water-soluble and are not suitable for use in practice from the viewpoint of the capability of stably preserving the developed images. In addition to the above, amine derivatives such as hexadecylamine, tribenzylamine, tricyclohexylamine, dioctadecylamine, N,N-dibenzylpiperazine and cychohexylbenzylamine are proposed. However, primary amines are unstable in the air and secondary and tertially amines having substituents such as alkyl group, aryl group and aralkyl group at the nitrogen atom are poor in preservability. Therefore, these amine derivatives are not suitable for use in practice.

In Japanese Patent Publication No. 51-29024, guanidine derivatives are proposed. However, guanidine is highly water-soluble. Therefore it is necessary to improve its preservability by making it insoluble or slightly soluble in water by bonding hydrophobic groups such as phenyl group and cyclohexyl group to guanidine or by making it a dimer. These derivatives have a decolorizing effect to some extent, but have the shortcomings that they are prone to be thermally decomposed, forming gases, and have poor preservability.

Therefore, it is preferable that a decolorizing agent for use in practice be basic, insoluble or slightly soluble in water, have a melting point of 80° C. or more, stable in the air and to heat, and the toxicity of the agent be very low.

Conventional thermosensitive recording adhesive labels are widely used, mainly as bar-code labels in the POS system. Recently they are also used in delivery systems in the fields of food and related industries and mail business, and in the automatic transportation systems for warehouse and the like. Thermosensitive recording bar code labels have the advantages over the preprinted bar code labels that the desired codes can be printed on the spot and they can be simultaneously controlled by computer systems. Recently it has been proposed to make a particular portion (for instance, a corrected portion) in a label attract attention by printing such portion with a color different from black. Therefore, there is a demand for a thermosensitive recording adhesive label capable of meeting the above proposal.

Further, conventional two-color thermosensitive recording adhesive labels have the shortcomings that the image density obtained in the low temperature color-forming layer is low and finger print coloring takes place in the high temperature coloring layer. When it is tried to increase the image density of the images developed in the low temperature color-forming layer, the decolorizing of the images becomes insufficient when image formation in the high temperature color-forming layer is carried out, so that color mixing inevitably takes place.

SUMMARY OF THE INVENTION

It is therefore an object of the present invention to provide a two-color thermosensitive recording adhesive label using leuco dyes capable of yielding clear color images with excellent color separation, having high densities, which color images do not discolor with time.

According to the present invention, the above object of the present invention is achieved by a two-color thermosensitive recording adhesive label comprising (1) a support material, (2) a first thermosensitive coloring layer (high temperature color-forming layer) and (3) a second thermosensitive coloring layer (low temperature color-forming layer) which are supported on the support material, (4) an adhesive layer formed on the other side of the support material, opposite to the thermosensitive coloring layers, and (5) a disposable backing sheet which is attached to the adhesive layer and can be peeled off the adhesive layer when the thermosensitive recording adhesive label is used, with the second thermosensitive coloring layer overlaid on the first thermosensitive coloring layer, the colors developed by the two coloring layers being different from each other, the coloring temperature for the second thermosensitive coloring layer being lower than that for the first thermosensitive coloring layer, in which at least the second thermosensitive coloring layer contains a basic leuco dye and a color developer capable of inducing color formation in the leuco dye upon application of thermal energy, and a decolorizing agent for decolorizing the color developed in the second thermosensitive coloring layer at the time of color development of the first thermosensitive coloring layer is located in such a position as to perform the decolorizing, which decolorizing agent is selected from the group consisting of (1) a piperazine derivative having the formula (I), (2) a piperazine derivative having the formula (II), (3) a di-substituted diamide derivative of dicarboxylic acid having the formula (III), (4) a piperazine derivative having the formula (IV), (5) a compound having three or more amide groups and (6) a compound having two or more amide groups and one or more tertiary amine groups.

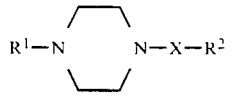

(I)

wherein $R^1$ and $R^2$ each represent a substituted or unsubstituted alkyl, cycloalkyl, aryl or aralkyl group, and X represents a carbonyl group or a sulfonyl group.

Examples of the above alkyl group are straight chain and branched alkyl groups having 1 to 18 carbon atoms; an example of the cycloalkyl group is cyclohexyl group; examples of the aryl group are phenyl group, tolyl group and xylyl group; and examples of the aralkyl group are benzyl group and phenethyl group.

The above groups can further have substituents, for example, alkyl group, aryl group, halogen, alkoxy group, aryloxy group, acyl group, acyloxy group, alkoxycarbonyl group, carbamoil group and acylamino group.

The piperazine ring in the above formula (I) can also have one or more substitutents, for example, alkyl group, aryl group, halogen, alkoxy group, aryloxy group, acyl group, acyloxy group, alkoxycarbonyl group, carbamoil group and acylamino group.

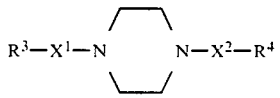

(II)

wherein $R^3$ and $R^4$ each represent a substituted or unsubstituted alkyl, cycloalkyl, aryl or aralkyl group, and $X^1$ and $X^2$ each represent a carbonyl group or a sulfonyl group.

Examples of the above alkyl group are straight chain and branched alkyl groups having 1 to 18 carbon atoms; an example of the cycloalkyl group is cyclohexyl group; examples of the aryl group are phenyl group, tolyl group and xylyl group; and examples of the aralkyl group are benzyl group and phenethyl group.

The above groups can further have substituents, for example, alkyl group, aryl group, halogen, alkoxy group, aryloxy group, acyl group, acyloxy group, alkoxycarbonyl group, carbamoil group and acylamino group.

The piperazine ring in the above formula (II) can also have one or more substitutents, for example, alkyl group, aryl group, halogen, alkoxy group, aryloxy group, acyl group, acyloxy group, alkoxycarbonyl group, carbamoil group and acylamino group.

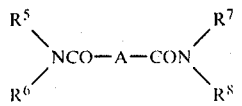

(III)

wherein $R^5$, $R^6$, $R^7$ and $R^8$ each represent a substituted or unsubstituted alkyl, cycloalkyl, aryl or aralkyl group, the combinations of $R^5$ and $R^6$, and $R^7$ and $R^8$, each can form a ring structure, and A represents an aliphatic group or an aromatic group.

Examples of the above alkyl group are straight chain and branched alkyl groups having 1 to 18 carbon atoms (preferably 4 to 18 carbon atoms); an example of the cycloalkyl group is cyclohexyl group; examples of the aryl group are phenyl group, tolyl group and xylyl group; and examples of the aralkyl group are benzyl group and phenethyl group.

The above groups can further have substituents, for example, alkyl group, aryl group, alkoxy group, acyl group, halogen, acylamino group (such as benzoylamino and acetylamino groups), alkoxycarbonyl group, carbamoil group, aryloxy group and aralkyloxy group. When A is an aliphatic group, it is preferable that the aliphatic group be an alkylene having 1 to 8 carbon atoms, and when A is an aromatic group, it is preferable that the aromatic group be an arylene group such as unsubstituted or substituted phenylene, tolylene and xylylene, and the substituents are, for example, halogen, acylamino group, alkoxycarbonyl group, carbamoyl, aryoxy group and aralkyloxy group.

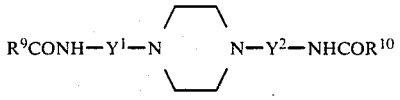

(IV)

wherein $R^9$ and $R^{10}$ each represent a substituted or unsubstituted alkyl, cycloalkyl, aryl or aralkyl group, and $Y^1$ and $Y^2$ each represent a straight or branched alkylene group.

Examples of the above alkyl group are straight chain and branched alkyl groups having 1 to 18 carbon atoms; an example of the cycloalkyl group is cyclohexyl group; examples of the aryl group are phenyl group, tolyl group and xylyl group; and examples of the aralkyl group are benzyl group and phenethyl group.

The above groups can further have substituents, for example, alkyl group, aryl group, halogen, alkoxy group, aryloxy group, aralkyloxy group, acyl group, acyloxy group, alkoxycarbonyl group, carbamoil group and acylamino group.

It is preferable that the alkylene group represented by $Y^1$ and $Y^2$ have 1 to 18 carbon atoms.

The piperazine ring in the formula (IV) can also have one or more substitutents, for example, alkyl group, aryl group, halogen, alkoxy group, aryloxy group, acyl group, acyloxy group, alkoxycarbonyl group, carbamoil group and acylamino group.

DETAILED DESCRIPTION OF THE PREFERRED EMBODIMENTS

Specific examples of the piperazine derivative having the formula (I) are as follows:

N-methyl-N'-phenylacetylpiperazine,
N-propyl-N'-phenylacetylpiperazine,
N-propyl-N'-benzoylpiperazine,
N-butyl-N'-benzoylpiperazine,
N-cyclohexyl-N'-benzoylpiperazine,
N-hexyl-N'-benzoylpiperazine,
N-lauryl-N'-benzoylpiperazine,
N-stearyl-N'-benzoylpiperazine,
N-phenyl-N'-benzoylpiperazine,
N-benzyl-N'-benzoylpiperazine,
N-phenyl-N'-cyclohexyloylpiperazine,
N-phenyl-N'-acetylpiperazine,
N-phenyl-N'-lauroylpiperazine,
N-phenyl-N'-p-methylbenzoylpiperazine,
N-phenyl-N'-p-chlorobenzoylpiperazine,
N-benzoylaminoethyl-N'-benzoylpiperazine,
N-benzoylaminopropyl-N'-benzoylpiperazine,
N-benzoylaminobutyl-N'-benzoylpiperazine,
N-benzoylaminopropyl-N'-cyclohexylpiperazine,
N-cyclohexyloylaminopropyl-N'-cyclohexyloylpiperazine,
N-benzoylaminoamyl-N'-benzoylpiperazine,
N-(p-chlorobenzoylaminoamyl)-N'-(chlorobenzoyl)-piperazine,
N-phenyl-N'-benzenesulfonylpiperazine,
N-benzyl-N'-benzenesulfonylpiperazine,
N-methyl-N'-benzenesulfonylpiperazine,
N-propyl-N'-benzenesulfonylpiperazine,
N-butyl-N'-benzenesulfonylpiperazine,
N-hexyl-N'-benzenesulfonylpiperazine,
N-cyclohexyl-N'-benzenesulfonylpiperazine,
N-lauryl-N'-benzenesulfonylpiperazine,
N-stearyl-N'-benzenesulfonylpiperazine,
N-phenyl-N'-butylsulfonylpiperazine,
N-phenyl-N'-laurylsulfonylpiperazine,
N-phenyl-N'-stearylsulfonylpiperazine,
N-phenyl-N'-cyclohexysulfonylpiperazine,
N-phenyl-N'-benzylsulfonylpiperazine,
N-phenyl-N'-(p-methylbenzenesulfonyl)piperazine,
N-butyl-N'-(p-methylbenzenesulfonyl)piperazine,
N-benzoylaminopropyl-N'-benzenesulfonylpiperazine,
N-benzoylaminopropyl-N'-p-methylbenzenesulfonyl-piperazine,
N-benzoylaminoethyl-N'-benzenesulfonylpiperazine,
N-benzoylaminobutyl-N'-benzenesulfonylpiperazine,
N-benzoylaminopropyl-N'-butanesulfonylpiperazine,
N-naphthoylaminopropyl-N'-benzenesulfonylpiperazine,
N-benzenesulfonylaminopropyl-N'-benzenesulfonyl-piperazine,
N-butyroylaminopropyl-N'-benzoylpiperazine,
N-hexyloylaminopropyl-N'-benzoylpiperazine,
N-lauroylaminopropyl-N'-benzoylpiperazine,
N-stearoylaminopropyl-N'-benzoylpiperazine, and
N-stearoylaminopropyl-N'-benzenesulfonylpiperazine.

Specific examples of the piperazine derivative having the formula (II) are as follows:

N,N'-bis(benzenesulfonyl)piperazine,
N,N'-bis(p-methylbenzenesulfonyl)piperazine,
N,N'-bis(p-isopropylbenzenesulfonyl)piperazine,
N,N'-bis(p-chlorobenzenesulfonyl)piperazine, N,N'-bis(o-chlorobenzenesulfonyl)piperazine,
N,N'-bis(m-chlorobenzenesulfonyl)piperazine,
N,N'-bis(p-bromobenzenesulfonyl)piperazine,
N,N'-bis(butylsulfonyl)piperazine,
N,N'-bis(octylsulfonyl)piperazine,
N,N'-bis(laurylsulfonyl)piperazine,
N,N'-bis(stearylsulfonyl)piperazine,
N,N'-bis(cyclohexylsulfonyl)piperazine,
N,N'-bis(p-laurylbenzenesulfonyl)piperazine,
N,N'-bis(cyclohexylsulfonyl)piperazine,
N-butylsulfonyl-N'-benzenesulfonylpiperazine,
N-octylsulfonyl-N'-benzenesulfonylpiperazine,
N-(o-chlorobenzenesulfonyl)-N'-benzenesulfonylpiperazine,
N-lauroyl-N'-benzenesulfonylpiperazine,
N-lauroyl-N'-(p-methylbenzenesulfonyl)piperazine,
N-benzoyl-N'-benzenesulfonylpiperazine,
N-(o-chlorobenzoyl)-N'-benzenesulfonylpiperazine,
N-(o-methylbenzoyl)-N'-benzenesulfonylpiperazine,
N,N'-bis(butyroyl)piperazine,
N,N'-bis(hexyloyl)piperazine,
N,N'-bis(n-octyloyl)piperazine, N,N'-bis(tert-octyloyl)-piperazine,
N,N'-bis(lauroyl)piperazine,
N,N'-bis(stearoyl)piperazine,
N,N'-bis(pivaloyl)piperazine,
N,N'-bis(cyclohexyloyl)piperazine,
N,N'-bis(p-methylcyclohexyloyl)piperazine,
N,N'-bis(p-methylphenylacetyl)piperazine,
N,N'-bis(phenylacetyl)piperazine,
N,N'-bis(phenylpropionyl)piperazine,
N,N'-bis(benzoyl)piperazine,
N,N'-bis(phenoxyacetyl)piperazine,
N,N'-bis(p-chlorobenzoyl)piperazine,
N,N'-bis(2-phenoxypropyonyl)piperazine,
N,N'-bis(m-chlorobenzoyl)piperazine,
N,N'-bis(o-chlorobenzoyl)piperazine,
N,N'-bis(p-methylbenzoyl)piperazine,
N,N'-bis(m-methylbenzoyl)piperazine,
N,N'-bis(o-methylbenzoyl)piperazine,
N,N'-bis(o-acetyloxybenzoyl)piperazine,
N,N'-bis(o-butyloxybenzoyl)piperazine,
N,N'-bis(p-phenylbenzoyl)piperazine,
N,N'-bis(p-methoxycarbonylbenzoyl)piperazine,
N,N'-bis(p-isopropoxycarbonylbenzoyl)piperazine, and
N,N'-bis(p-octadecylcarbamoylbenzoyl)piperazine.

Specific examples of the di-substituted amides of aliphatic and aromatic dicarboxylic acids, having the formula (III), are as follows:

N,N,N',N'-tetra-butylsuccinic acid diamide,
N,N,N',N'-tetra-octylsuccinic acid diamide,
N,N,N',N'-tetra-laurylsuccinic acid diamide,
N,N,N',N'-tetra-stearylsuccinic acid diamide,
N,N,N',N'-tetra-phenyladipic acid diamide,
N,N,N',N'-tetra-p-butylphenyladipic acid diamide,
N,N,N',N'-tetra-butyladipic acid diamide,
N,N,N',N'-tetra-octyladipic acid diamide,
N,N,N',N'-tetra-lauryladipc acid diamide,
N,N,N',N'-tetra-stearyladipic acid diamide,
N,N'-dicyclohexyl-N,N'-dimethylsuccinic acid diamide,
N,N'-dicyclohexyl-N,N'-dimethylglutaric acid diamide,
N,N'-dicyclohexyl-N,N'-dimethyladipic acid diamide,
N,N,N',N'-tetra-cyclohexyladipic acid diamide,
N,N'-dimethyl-N,N'-dicyclohexylsuberic acid diamide,
N,N'-dimethyl-N,N'-dicyclohexylsebacic acid diamide,
N,N'-dimethyl-N,N'-dicyclohexylmalonic acid diamide,
N,N,N',N'-tetra-benzyladipic acid diamide,
adipoyldipiperidine,
adipoyldipecoline,
adipoyl-di-ε-caprolactam,
adipoyl-di-pyrrolidone,
adipoyl-di-piperidone,
sebacoyl-di-ε-caprolactam,
sebacoyl-di-piperidine, adipoyl-di-3-chloro-ε-caprolactam, succinyl-di-3-chloro-ε-caprolactam,
N,N'-terephthaloybispiperidine,
N,N'-isophthaloylbispiperidine,
N,N'-phthaloylbisperidine,
N,N'-terephthaloylbismorpholine,
N,N'-isophthaloylbismorpholine,
N,N'-phthaloylbismorpholine,
N,N'-terephthaloylbis-4-methylpiperazine,
N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloyl-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbiscyclohexyl-methylamine,
N,N'-terephthaloylbis-dicyclohexylamine,
N,N'-isophthaloylbis-dicyclohexylamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-4-chlorobutylamine,
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine,
N,N'-isophthaloylbis-diacetylaminoethylamine,
N,N'-terephthaloylbis(4-methylpiperidine),
N,N'-terephthaloylbis(3-methylpiperidine),
N,N'-terephthaloylbis(3,5-dimethylpiperidine),
N,N'-terephthaloylbis(2-methylpiperidine),
N,N'-terephthaloylbis(2,6-dimethylpiperidine),
N,N'-isophthaloylbis(4-methylpiperidine),
N,N'-phthaloylbis(4-methylpiperidine),
N,N'-isophthaloylbis(3-methylpiperidine),
N,N'-phthaloylbis(3-methylpiperidine), N,N'-isophthaloylbis(3,5-dimethylpiperidine),
N,N'-phthaloylbis(3,5-dimethylpiperidine),
N,N'-isophthaloylbis(2-methylpiperidine),
N,N'-phthaloylbis(2-methylpiperidine),
N,N'-isophthaloylbis(2,6-dimethylpiperidine),
N,N'-phthaloylbis(2,6-dimethylpiperidine),
N,N'-terephthaloylbis(4-benzylpiperidine),
N,N'-isophthaloylbis(4-benzylpiperidine),
N,N'-phthaloylbis(4-benzylpiperidine),
N,N'-terephthaloylbis(4-methoxycarbonylpiperidine),
N,N'-isophthaloylbis(4-methoxycarbonylpiperidine),
N,N'-terephthaloylbis(2-methoxycarbonylpiperidine),
N,N'-isophthaloylbis(2-methoxycarbonylpiperidine),
N,N'-phthaloylbis(2-methoxycarbonylpiperidine),
N,N'-terephthaloylbis(4-ethylpiperidine),
N,N'-terephthaloylbis(4-propylpiperidine),
N,N'-terephthaloylbis(4-butylpiperidine),
N,N'-isophthaloylbis(4-ethylpiperidine),
N,N'-isophthaloylbis(4-n-propylpiperidine),
N,N'-isophthaloylbis(4-butylpiperidine),
N,N'-phthaloylbis(4-ethylpiperidine),
N,N'-phthaloylbis(4-propylpiperidine),
N,N'-phthaloylbis(4-butylpiperidine),
N,N'-terephthaloylbis(3-hydroxymethylpiperidine),
N,N'-isophthaloylbis(3-hydroxymethylpiperidine),
N,N'-phthaloylbis(3-hydroxymethylpiperidine),
N,N'-terephthaloylbis(5-ethyl-2-methylpiperidine),
N,N'-isophthaloylbis(5-ethyl-2-methylpiperidine),
N,N'-phthaloylbis(5-ethyl-2-methylpiperidine).
N,N'-terephthaloylbis(N-ethyl-N'-cyclohexylamine),
N,N'-isophthaloylbis(N-ethyl-N'-cyclohexylamine),
N,N'-phthaloylbis(N-ethyl-N'-cyclohexylamine),
N,N'-terephthaloylbis(N-propyl-N'-cyclohexylamine),
N,N'-isophthaloylbis(N-propyl-N'-cyclohexylamine),
N,N'-phthaloylbis(N-propyl-N'-cyclohexylamine),
N,N'-terephthaloylbis(N-butyl-N'-cyclohexylamine),
N,N'-isophthaloylbis(N-butyl-N'-cyclohexylamine),
N,N'-phthaloylbis(N-butyl-N'-cyclohexylamine),
N,N'-terephthaloylbis(4-ethyloxymethylpiperidine),
N,N'-isophthaloylbis(4-ethyloxymethylpiperidine),
N,N'-terephthaloylbis(4-ethyloxyethylpiperidine),
N,N'-isophthaloylbis(4-ethyloxyethylpiperidine),
N,N'-terephthaloylbis(2-methoxyethylpiperidine),
N,N'-isophthaloylbis(2-methoxyethylpiperidine),
N,N'-terephthaloylbis(4-methoxyethylpiperidine),
N,N'-isophthaloylbis(4-methoxyethylpiperidine),
N,N'-terephthaloylbis(4-phenylpiperidine),
N,N'-isophthaloylbis(4-phenylpiperidine),
N,N'-phthaloylbis(4-phenylpiperidine),
N,N'-terephthaloylbis(4-phenylpropylpiperidine),
N,N'-isophthaloylbis(4-phenylpropylpiperidine), and
N,N'-phthaloylbis(4-phenylpropylpiperidine).

Specific examples of the piperazine derivative having the formula (IV) are as follows:

N,N'-bis(benzoylaminoethyl)piperazine,
N,N'-bis(benzoylaminopropyl)piperazine,
N,N'-bis(benzoylaminobutyl)piperazine,
N,N'-bis(cyclohexylaminopropyl)piperazine,
N,N'-bis(hexyloylaminopropyl)piperazine,
N-benzoylaminopropyl-N'-cyclohexylaminoethylpiperazine,
N-benzoylaminopropyl-N'-benzoylaminobutylpiperazine,
N-(p-chlorobenzoylaminoamyl)-N'-benzoylaminopropylpiperazine,
N-cyclohexyloylaminopropyl-N'-cyclohexyloylaminobutylpiperazine,
N-napthoylaminopropyl-N'-benzoylaminopropylpiperazine,
N-butyloylaminopropyl-N'-benzoylaminopropylpiperazine,
N-lauroylaminopropyl-N'-benzoylaminopropylpiperazine,
N-stearoylaminopropyl-N'-benzoylaminopropylpiperazine,
N-butyroylaminopropyl-N'-cyclohexyloylaminobutylpiperazine,
N-naphthoylaminopropyl-N'-lauroylaminopropylpiperazine, and
N-naphthoylaminopropyl-N'-stearoylaminopropylpiperazine.

Specific examples of a compound having three or more amide groups and a compound having two or more amide groups and one or more tertially amino groups are as follows:

N,N',N''-tribenzoyl-diethylenetriamine,
N,N',N''-tribenzoyl-dipropylenetriamine,
N,N',N'',N'''-tetrabenzoyl-triethylenetetramine,
1,7-dibenzoyl-4-methyl-diethylenetriamine,
1,9-dibenzoyl-5-methyl-dipropylenetriamine,
1,7-di-α-naphthoyl-4-methyl-diethyltriamine,
1,7-di-α-naphthoyl-4-cyclohexyl-diethylenetriamine,
N,N',N''-tripivaloyl-diethylenetriamine,
N,N',N'',N'''-tetraacetyl-triethylenetetramine,
N,N',N'',N'''-tetracyclohexyoyl-triethylenetetramine,
ethylenediamine tetra-acetic acid tetraanilide,
ethylenediamine tetra-acetic acid tetracycohexylamide,
ethylenediamine tetra-acetic acid tetra-2-ethylhexylamide,
ethylenediamine tetra-acetic acid tetralaurylamide,
ethylenediamine tetra-acetic acid tetrastearylamide,
ethylenediamine tetra-acetic acid tetrapiperidide,
ethylenediamine tetra-acetic acid tetra-ε-caprolactamide.

The above listed decolorizing agents for use in the present invention can be used alone or in combination. These agents are white, stable solids in the air. In the present invention, it is preferable that the melting point of the decolorizing agents be 80° C. or more, more preferably in the range of 120° C. to 250° C.

In the present invention, it is only necessary that the decolorizing agent be located in such a position that the color developed in the second thermosensitive coloring layer can be decolorized at the time of color development of the first thermosensitive coloring layer by application of higher thermal energy thereto. Generally, the decolorizing agent is contained in an intermediate decolorizing layer interposed between the first thermosensitive coloring layer and the second thermosensitive coloring layer. Alternatively the decolorizing agent is contained in the first thermosensitive coloring layer.

In the present invention, as the coloring agents for use in the second thermosensitive coloring layer, such coloring agents are employed that are capable of yielding stable colored images by application of a relatively low amount of thermal energy, which colored images can be readily decolored by the above mentioned decolorizing agents. Specifically, in the present invention, basic leuco dyes are employed in the second thermosensitive coloring layer. As the coloring agents for use in the first thermosensitive coloring agents, such coloring agents that are capable of yielding colored images which are hardly decolorized by the above decolorizing agents. Therefore, as such coloring agents, not only leuco dyes, but also conventional dyes that can be colored by application of thermal energy can be employed.

The two-color thermosensitive recording adhesive label according to the present invention has the advantages over conventional two-color thermosensitive recording materials that the whiteness of the background is high and can be maintained over a long period of time, the image density obtained in the second thermosensitive coloring layer (with application of a lower thermal energy) is high and does not deteriorate with time, and clear color images which do not discolor with time can be obtained with excellent color separation.

In the two-color thermosensitive recording adhesive label according to the present invention, when necessary, an intermediate layer comprising, for example, a thermofusible material, a water-soluble resin, a latex resin and/or a filler, can be interposed between a decolorizing layer (situated above the first thermosensitive coloring layer) and the first thermosensitive coloring layer, between the decolorizing layer and the second thermosensitive coloring layer, or between a first thermosensitive coloring layer containing a decolorizing agent and the second thermosensitive coloring layer for improving image quality with excellent color separation.

Further, one or more protective layers can be formed on the second thermosensitive coloring layer for protecting the developed images.

Furthermore, in the present invention, an adhesive layer is formed on the back side of the support material, opposite to the thermosensitive coloring layers, with a disposable backing sheet attached to the adhesive layer, which disposable backing sheet can be peeled off the adhesive layer when the thermosensitive recording adhesive label is used.

As the basic leuco dyes for use in the second thermosensitive coloring layer in the present invention, the leuco dyes conventionally employed in the field of thermosensitive recording materials can also employed. They can be used alone or in combination. Examples of such leuco dyes are triphenylmethane-type leuco compounds, fluoran-type leuco compounds, phenothiazine-type leuco compounds, auramine-type leuco compounds and spiropyran-type leuco compounds. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-diethylamino-6-chloro-7-methylfluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-dibutylamino-7-(o-fluoroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N-isoacyl-N-ethyl)amino-7-(o-chloroanilino)fluoran,
3-(N-hexyl-N-methyl)amino-7-(o-chloroanilino)fluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

As mentioned previously, these leuco dyes can be used alone or in combination.

Examples of preferable basic leuco dyes for use in the second thermosensitive coloring layer are as follows:

3-diethylamino-7-chlorofluoran,
3-diethylamino-6-methyl-7-chlorofluoran,
3-cychohexylamino-6-chlorofluoran, and
3-diethylaminobenzo[α]fluoran.

Furthermore, in the first thermosensitive coloring layer, acidic leuco dyes, for example, acylated lactones and sultone-type leuco dyes can be contained:

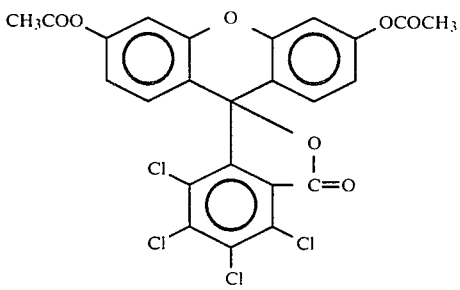

No. 1

-continued

No. 2

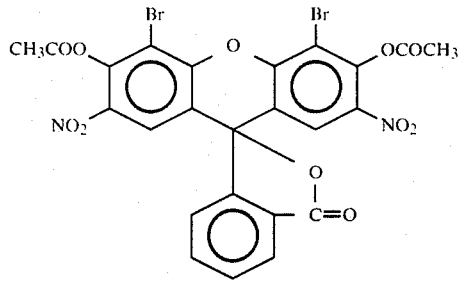

No. 3

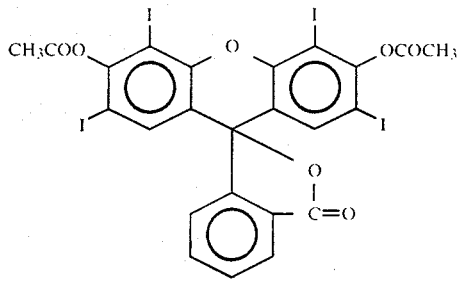

No. 4

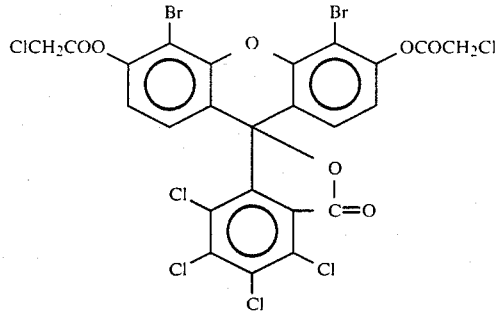

No. 5

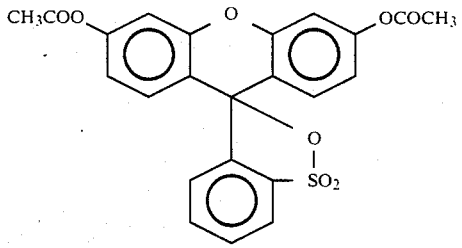

No. 6

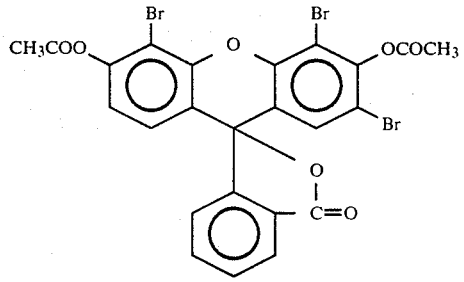

As the color developers capable of inducing color formation in the above mentioned basic leuco dyes upon application of heat, for example, the following can be employed:

N,N'-diphenylthiourea,
N-p-ethylphenyl-N'-phenylthiourea,
N-p-butylphenyl-N'-phenylthiourea,
N,N'-di(m-chlorophenyl)thiourea,
N,N'-di(p-chlorophenyl)thiourea,
N,N'-di(m-trifluoromethylphenyl)thiourea,
N,N'-di(m-methylphenyl)thiourea,
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2,6-dimethylphenol),
4,4'-isopropylidenebis(2-tert-butylphenol),
4,4'-sec-butylidenediphenol,
4,4'-cyclohexylidenebisphenol,
4,4'-cychlohexylidenebis(2-methylphenol),
4-tert-butylphenol,
4-phenylphenol,
4-hydroxydiphenoxide,
α-naphthol,
β-naphthol,
3,5-xylenol,
thymol,
methyl 4-hydroxybenzoate,
4-hyroxyacetophenone,
novolak-type phenolic resin,
2,2'-thiobis(4,6-dichlorophenol),
catechol,
resorcinol,
hydroquinone,
pyrogallol,
phloroglucine,
phloroglucinocarboxylic acid,
4-tert-octylcatechol,
2,2'-methylenebis(4-chlorophenol),
2,2'-methlenebis(4-methyl-6-tert-butylphenol),
2,2'-dihydroxy-diphenyl,
ethyl p-hydroxybenzoate,
propyl p-hydroxybenzoate,
butyl p-hydroxybenzoate,
benzyl p-hydroxy-benzoate,
p-chlorobenzyl p-hydroxybenzoate,
o-chlorobenzyl p-hydroxybenzoate,
p-methylbenzyl p-hydroxybenzoate,
n-octyl p-hydroxybenzoate,
benzoic acid,
1-hydroxy-2-naphthoic acid,
2-hydroxy-6-naphthoic acid,
4-hydroxy diphenyl sulfone,
4-hydroxy-4'-chlorodiphenyl sulfone,
bis(4-hydroxyphenyl)sulfide,
o-sulfophthalimide,
5-isopropyl-o-sulfophthalimide,
5-tert-butyl-o-sulfophthalimide, and
5-octyl-o-sulfophtalimide.

In addition to the previously mentioned leuco dye coloring systems, the following coloring systems can also be employed in the first thermosensitive coloring layer:

(1) A thermosensitive coloring system comprising a combination of (a) a long-chain fatty acid iron salt such as iron stearate and iron myristate, and (b) a phenolic compound such as gallic acid and ammonium salicylate.

(2) A thermosensitive coloring system comprising a combination of (a) an organic heavy metal salt such as nickel-, cobalt-, lead-, copper-, iron-, mercury- and sliver-salts of acetic acid, stearic acid and palmitic acid and (b) an alkali earth metal sulfide, such as calcium sulfide, strontium sulfide and potassium sulfide, or a combination of (a) one of the above organic heavy metal salts and (c) an organic chelating agent such as s-diphenylcarbazide and diphenylcarbazone.

(3) A thermosensitive coloring system comprising a combination of (a) a heavy metal sulfate, such as silver sulfate, lead sulfate, mercury sulfate and thorium sulfate, and (b) a sulfur compound such as sodium tetrathionate, sodium thiosulfate and thiourea.

(4) A thermosensitive coloring system comprising a combination of (a) a fatty acid iron salt such as iron stearate and (b) an aromatic polyhydroxy compound such as 3,4-dihydroxytetraphenylmethanre.

(5) A thermosensitive colroing system comprising a combination of (a) an organic acid noble metal salt such as silver oxalate and mercury oxalate and (b) an organic polyhydroxy compound such as polyhydroxy alcohol, glycerol and glycol.

(6) A thermosensitive coloring system comprising a combination of (a) an organic acid metal salt such as silver behenate and silver stearate and (b) an aromatic organic reducing agent such as protocatechuic acid, spiro-indane and hydroquinone.

(7) A thermosensitive coloring system comprising a combination of (a) a fatty acid iron salt such as iron pelagonate and iron lurate and (b) a thiosemicarbamide derivative or an isothiosemicarbamide derivative.

(8) A thermosensitive coloring system comprising a combination of (a) an organic acid lead salt such as lead caproate, lead pelargonate and lead behenate and (b) a thiourea derivative such as ethylenethiourea and N-dodecylthiourea.

(9) A thermosensitive coloring system comprising a combination of (a) a higher fatty acid heavy metal salt such as iron stearate and copper stearate and (b) lead dialkyl dithocarbamate.

(10) A thermosensitive coloring system capable of forming an oxazine dye, for instance, a coloring system comprising a combination of (a) resorcinol and (b) a nitroso compound, and a thermosensitive coloring system forming an azo dye.

(11) A thermosensitive coloring system comprising a combination of an aromatic diazonium compound and a coupler.

(12) A thermosensitive coloring system comprising a combination of a formazan compound and a metal salt.

In the present invention, a wide variety of conventional binder agents can be employed for fixing the abovementioned thermosensitive coloring layers and decolorizing layer to the support material and to the other layers in contact therewith.

Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid three-dimensional copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

In the present invention, when necessary, auxiliary additives which are conventionally employed in the thermosensitive recording materials of this type, for example, fillers, surface active agents and thermofusible materials, can be added to the above mentioned leuco dyes and color developers.

Specific examples of the fillers are calcium carbonate, silica, zinc oxide, titanium oxide, aluminum hydroxide, zinc hydroxide, barium sulfate, clay, talc, surface-treated inorganic powder, for example, of calcium and silica, and powder of organic materials, such as urea-formaldehyde resin, styrene/methacrylic acid copolymer and polystyrene.

Specific examples of the thermofusible materials are higher fatty acids, esters, amides and metal salts of higher fatty acids, a variety of waxes, condensates of aromatic carboxylic acids and amines, benzoic acid phenyl esters, higher straight-chain glycols, 3,4-epoxydialkyl hexahydrophthalate, higher ketones, and other thermofusible organic compounds having a melting point in the range of about 50° C. to about 200° C.

As the adhesive agent for attaching a disposable backing sheet to the back side of the support material, polyvinyl alcohol, polyvinyl acetate, polyacrylic acid and copolymers of the monomers of the former polymers are generally employed. As the disposable backing sheet, a sheet consisting essentially of a base sheet and a non-sticking layer formed thereon comprising a silicone resin or a sheet impregnated with a silicone resin is employed for facilitating the peeling of the backing sheet off the adhesive layer when the thermosensitive recording adhesive label according to the present invention is used.

The thermosensitive recording adhesive label according to the present invention can be prepared by coating a first thermosensitive coloring layer formation liquid (dispersion or solution) comprising a coloring agent, a color developer, a decolorizing agent and a binder agent on one side of a support material such as paper, synthetic paper, or a plastic film and drying the coated liquid. After forming a first thermosensitive coloring layer, a second thermosensitive coloring layer formation liquid comprising a coloring agent, a color developer and a binder agent is coated on the first thermosensitive coloring layer. At the time of coating the second thermosensitive coloring layer formation liquid, care must be taken with respect to the mutual solubilities of the components of the first and second thermosensitive coloring layers and the peeling of the first thermosensitive coloring layer, so as not to cause the mixing of the second thermosensitive coloring layer formation liquid with the components of the first thermosensitive coloring layer and the peeling of the first thermosensitive coloring layer. Before coating the second thermosensitive coloring layer formation liquid on the first thermosensitive coloring layer, the first thermosensitive coloring layer can be subjected to calendering for facilitating the perfect coating of the second thermosensitive coloring layer.

It is preferable that the deposition amount of a dye component in the first thermosensitive coloring layer be in the range of 0.3 $g/m^2$ to 1.0 $g/m^2$, the deposition amount of a decolorizing agent in a decolorizing layer be in the range of 1.0 $g/m^2$ to 10 $g/m^2$, and the deposition amount of a dye component in the second thermosensitive coloring layer be in the range of 0.2 $g/m^2$ to 0.8 $g/m^2$.

It is preferable that the ratio by weight of a dye component to a color developer for the dye component in each coloring layer be (1:1) to (1:5).

When a protective layer is formed on the second thermosensitive coloring layer, it is preferable that the deposition amount of the protective layer (on dry basis) be in the range of 0.5 g/m$^2$ to 5.0 g/m$^2$.

When an intermediate layer is formed between the decolorizing layer and the second thermosensitive coloring layer, it is preferable that the deposition amount of the intermediate layer (on dry basis) be in the range of 0.5 g/m$^2$ to 5.0 g/m$^2$, while when an intermediate layer is formed between the decolorizing layer and the first thermosensitive coloring layer, it is preferable that the deposition amount of the intermediate layer (on dry basis) be in the range of 1 g/m$^2$ to 10 g/m$^2$.

The adhesive layer can be formed on the back side of the support material by coating an aqueous emulsion by a conventional method or by coating an adhesive composition by a hot-melt method or a transfer method.

By referring to the following examples, the present invention will now be explained in detail.

EXAMPLE 1

(1) Preparation of First Thermosensitive Coloring Layer Formation Liquid

Dispersions A-1, B-1 and C were prepared by dispersing the following components of each dispersion in a sand grinder.

| | Parts by Weight |
|---|---|
| Dispersion A-1 | |
| 3-diethylamino-7-chlorofluoran (Red) | 10 |
| 10% aqueous solution of polyvinyl alcohol | 10 |
| Water | 30 |
| Dispersion B-1 | |
| 4,4'-dihydroxydiphenylsulfone | 30 |
| 10% aqueous solution of polyvinyl alcohol | 30 |
| Water | 90 |
| Dispersion C | |
| Silica powder | 20 |
| Zinc stearate | 5 |
| 1,4-dibenzyloxynapthalene | 20 |
| 10% aqueous solution of polyvinyl alcohol | 22.5 |
| Water | 112.5 |

The above prepared Dispersion A-1, Dispersion B-1 and Dispersion C were mixed well in a ratio by weight of 1:1:1, so that a first thermosensitive coloring layer formation liquid was prepared.

(2) Preparation of Decolorizing Layer Formation Liquid

Decolorizing layer formation liquid D-1 was prepared by dispersing the following components in a sand grinder.

| Decolorizing Layer Formation Liquid D-1 | Parts by Weight |
|---|---|
| Mixture of terephthaloyldipiperidide and isophthaloyl-di(cyclohexyl-methylamide) (1:1) | 80 |
| 10% aqueous solution of polyvinyl alcohol | 80 |
| Water | 240 |

(2) Preparation of Second Thermosensitive Coloring Layer Formation Liquid

Dispersions A-2, B-2 and C were prepared by dispersing the following components of each dispersion in a sand grinder.

| | Parts by Weight |
|---|---|
| Dispersion A-2 | |
| 3-dibutylamyl-7-(o-chloroanilino)-fluoran (Black) | 10 |
| 10% aqueous solution of polyvinyl alcohol | 10 |
| Water | 30 |
| Dispersion B-2 | |
| 3,3-dichlorophenylthiourea | 30 |
| 10% aqueous solution of polyvinyl alcohol | 30 |
| Water | 90 |

The above prepared Dispersion A-2, Dispersion B-2 and Dispersion C were mixed well in a ratio by weight of 1:1:1, so that a second thermosensitive coloring layer formation liquid was prepared.

(4) Preparation of Protective Layer Formation Liquid

Protective layer formation liquid E was prepared by dispersing the following components in a sand grinder.

| Protective Layer Formation Liquid E | Parts by Weight |
|---|---|
| 10% aqueous solution of polyvinyl alcohol | 20 |
| Finely-divided silica particles | 0.5 |
| Zinc stearate | 0.1 |
| Water | 10 |

The first thermosensitive coloring layer formation liquid was first coated by a laboratory coating rod on a sheet of commercially available high quality paper (with a basis weight of about 70 g/m$^2$) with a coloring dye component deposition of 0.5 g/m$^2$ when dried, so that a first thermosensitive coloring layer was formed on the high quality paper.

The decolorizing layer formation liquid was then coated on the first thermosensitive coloring layer with a deposition of 4 g/m$^2$ when dried, so that a decolorizing layer was formed on the first thermosensitive coloring layer.

The second thermosensitive coloring layer formation liquid was then coated on the decolorizing layer with a coloring dye component deposition of 0.50 g/m$^2$ when dried, so that a second thermosensitive coloring layer was formed on the decolorizing layer.

The protective layer formation liquid was then coated on the second thermosensitive coloring layer with a deposition of 4 g/m$^2$ when dried, so that a two-color thermosensitive recording material was prepared. This two-thermosensitive recording material was subjected to calendering so as to make the surface of the thermosensitive recording material smooth.

Finally, a conventional adhesive material was applied to the back side of the support material and a disposable backing sheet was then attached thereto, whereby a two-color thermosensitive recording adhesive label No. 1 according to the present invention was prepared.

The two-color thermosensitive recording adhesive label No. 1 according to the present invention was subjected to a thermal printing test by use of a bar-code printer under the conditions that the power applied to a printer head thereof for coloring the second thermosensitive coloring layer was 0.9 mJ/dot and the power applied to the head for coloring the first thermosensitive coloring layer was 2.8 mJ/dot.

As a result, a clear black image having an image density of 1.0 was obtained in the second thermosensitive coloring layer and a clear orange red image having an image density of 1.0 was obtained with clear-cut color separation in the first thermosensitive coloring layer. These images were stable in quality and did not deteriorate with time even if they were allowed to stand at room temperature over an extended period of time.

Further, cotton seed oil and conventionally employed plasticizers were applied to the images and the recording adhesive label was allowed to stand for several days. The result was that there were no changes in the image areas and the background.

EXAMPLE 2

Dispersion F was prepared by dispersing the following components uniformly in a mixer, whereby an intermediate layer formation liquid was prepared.

| Dispersion F | Parts by Weight |
|---|---|
| Polyvinylidene chloride latex (solid component: 50%) | 10 |
| High concentration polyethylene wax dispersion (solid component: 50%) | 40 |
| Water | 70 |

Example 1 was repeated except that an intermediate layer was formed between the decolorizing layer and the second thermosensitive coloring layer, using the above prepared intermediate layer formation liquid, with a deposition of 2.5 g/m$^2$ when dried, whereby a two-color thermosensitive recording adhesive label No. 2 according to the present invention was prepared.

The two-color thermosensitive recording adhesive label No. 2 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 3.0 mJ/dot.

As a result, a clear black image having an image density of 1.3 was obtained in the second thermosensitive coloring layer and a clear orange red image with clear-cut color separation was obtained in the first thermosensitive coloring layer. These images were stable in quality and did not deteriorate with time even if they were allowed to stand in a temperature-constant chamber at 40° C. for 2 days.

EXAMPLE 3

Example 1 was repeated except that two intermediate layers were formed, one between the decolorizing layer and the second thermosensitive coloring layer, and the other between the decolorizing layer and the first thermosensitive coloring layer, using the intermediate layer formation liquid prepared in Example 2, with a deposition of 2.5 g/m$^2$ when dried for each intermediate layer, whereby a two-color thermosensitive recording adhesive label No. 3 according to the present invention was prepared.

The two-color thermosensitive recording adhesive label No. 3 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 3.0 mJ/dot.

As a result, a clear black image having an image density of 1.3 was obtained in the second thermosensitive coloring layer and a clear orange red image with clear-cut color separation was obtained in the first thermosensitive coloring layer. These images were stable in quality and did not deteriorate with time even if they were allowed to stand in a temperature-constant chamber at 40° C. for 2 days.

EXAMPLE 4

Example 1 was repeated except that the decolorizing layer formation liquid D-1 employed in Example 1 was replaced by the following decolorizing layer formation liquid D-2, whereby a thermosensitive recording adhesive label No. 4 according to the present invention was prepared.

| Decolorizing Layer Formation Liquid D-2 | Parts by Weight |
|---|---|
| Mixture of terephthaloyldipiperidide and N,N'—bis(benzoylaminopropyl) piperazine (1:1) | 80 |
| 10% aqueous solution of polyvinyl alcohol | 80 |
| Water | 240 |

The two-color thermosensitive recording adhesive label No. 4 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 2.8 mJ/dot.

As a result, a clear black image having high image density was obtained in the second thermosensitive coloring layer and a clear orange red image having high image density with clear-cut color separation was obtained in the first thermosensitive coloring layer. These images were stable in quality and did not deteriorate with time even if they were allowed to stand in a temperature-constant chamber at 40° C. for 2 days.

EXAMPLE 5

Example 1 was repeated except that the decolorizing layer formation liquid D-1 employed in Example 1 was replaced by the following decolorizing layer formation liquid D-3, whereby a thermosensitive recording adhesive label No. 5 according to the present invention was prepared.

| Decolorizing Layer Formation Liquid D-3 | Parts by Weight |
|---|---|
| Mixture of terephthaloyldipiperidide and N,N'—dicyclohexyl-N''—diphenylguanidine (1:1) | 80 |
| 10% aqueous solution of polyvinyl alcohol | 80 |
| Water | 240 |

The two-color thermosensitive recording adhesive label No. 5 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 2.8 mJ/dot.

As a result, a clear black image having high image density was obtained in the second thermosensitive coloring layer and a clear orange red image having high image density with clear-cut color separation was obtained in the first thermosensitive coloring layer. These images were stable in quality and did not deteriorate with time even if they were allowed to stand in a temperature-constant chamber at 40° C. for 2 days.

EXAMPLE 6

Example 1 was repeated except that the dispersion A-1 employed in Example 1 was replaced by the following dispersion A-1-1, whereby a thermosensitive recording adhesive label No. 6 according to the present invention was prepared.

| Dispersion A-1-1 | Parts by Weight |
|---|---|
| 3-diethylamino-6,8-dimethylfluran | 10 |
| 10% aqueous solution of polyvinyl alcohol | 10 |
| Water | 30 |

The two-color thermosensitive recording adhesive label No. 6 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 2.8 mJ/dot.

As a result, a clear black image having high image density was obtained in the second thermosensitive coloring layer and a clear orange red image having high image density with clear-cut color separation was obtained in the first thermosensitive coloring layer. These images were stable in quality and did not deteriorate with time even if they were allowed to stand in a temperature-constant chamber at 40° C. for 2 days.

EXAMPLE 7

Example 1 was repeated except that the dispersion A-2 employed in Example 1 was replaced by the following dispersion A-2-1, whereby a thermosensitive recording adhesive label No. 7 according to the present invention was prepared.

| Dispersion A-2-1 | Parts by Weight |
|---|---|
| 3-(N—ethyl-N—isoamyl)amino-7-o-chloroanilinofluoran | 10 |
| 10% aqueous solution of polyvinyl alcohol | 10 |
| Water | 30 |

The two-color thermosensitive recording adhesive label No. 7 according to the present invention was subjected to a thermal printing test by use of a bar-code printer under the conditions that the power applied to a printer head thereof for coloring the second thermosensitive coloring layer was 1.0 mJ/dot and the power applied to the head for coloring the first thermosensitive coloring layer was 2.8 mJ/dot.

As a result, a clear black image having high image density was obtained in the second thermosensitive coloring layer and a clear orange red image having high image density with clear-cut color separation was obtained in the first thermosensitive coloring layer. These images were stable in quality and did not deteriorate with time even if they were allowed to stand in a temperature-constant chamber at 40° C. for 2 days.

COMPARATIVE EXAMPLE1

Example 1 was repeated except that the decolorizing layer formation liquid D-1 employed in Example 1 was replaced by the following comparative decolorizing layer formation liquid CD-1, whereby a comparative thermosensitive recording adhesive label No. ·1 was prepared.

| Comparative Decolorizing Layer Formation Liquid CD-1 | Parts by Weight |
|---|---|
| Octadecylamine | 80 |
| 10% aqueous solution of polyvinyl alcohol | 80 |
| Water | 240 |

COMPARATIVE EXAMPLE 2

Example 1 was repeated except that the decolorizing layer formation liquid D-1 employed in Example 1 was replaced by the following comparative decolorizing layer formation liquid CD-2, whereby a comparative thermosensitive recording adhesive label No. 2 was prepared.

| Comparative Decolorizing Layer Formation Liquid CD-2 | Parts by Weight |
|---|---|
| Tribenzylamine | 80 |
| 10% aqueous solution of polyvinyl alcohol | 80 |
| Water | 240 |

COMPARATIVE EXAMPLE 3

Example 1 was repeated except that the decolorzing layer formation liquid D-1 employed in Example 1 was replaced by the following comparative decolorizing layer formation liquid CD-3, whereby a comparative thermosensitive recording adhesive label No. 3 was prepared.

| Comparative Decolorizing Layer Formation Liquid CD-3 | Parts by Weight |
|---|---|
| N,N,N',N'—tetrabenzylhexamethylenediamine | 80 |
| 10% aqueous solution of polyvinyl alcohol | 80 |
| Water | 240 |

In the course of the preparation of the above comparative examples Nos. 1 through 3, the background became yellowish and such discoloring became considerable with time. The thermal printing tests indicated that the image density of each black image was too low to use in practice and the developed colored images were mostly decolorized with time.

What is claimed is:

1. A two-color thermosensitive recording adhesive label comprising:

(a) a support material, (b) a first thermosensitive coloring layer formed on said support material, (c) a second thermosensitive coloring layer formed above said first thermosensitive coloring layer, (d) an adhesive layer formed on the other side of said support material, opposite to said thermosensitive coloring layers, and (e) a disposable backing sheet which is attached to said adhesive layer and can be peeled off said adhesive layer when said thermosensitive recording adhesive label is used, with the colors developed by said two coloring layers being different from each other, the coloring temperature for said second thermosensitive coloring layer being lower than that for said first thermosensitive coloring layer, in which at least said second thermosensitive coloring layer contains a basic leuco dye and a color developer capable of inducing color formation in said leuco dye upon application of thermal energy, and a decolorizing agent for decolorizing the color developed in said second thermosensitive coloring layer at the time of color development of said first thermosensitive coloring layer is located in such a position as to perform said decolorizing, which decolorizing agent is selected from the group consisting of:

(1) a piperazine derivative having the formula (I),

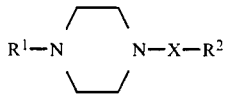

(I)

wherein $R^1$ and $R^2$ each represent a substituted or unsubstituted alkyl, cycloalkyl, aryl or aralkyl group, X represents a carbonyl group or a sulfonyl group, and the above pirperazine ring can have one or more substituents;

(2) a piperazine derivative having the formula (II),

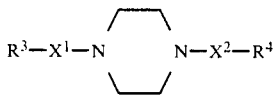

(II)

wherein $R^3$ and $R^4$ each represent a substituted or unsubstituted alkyl, cycloalkyl, aryl or aralkyl group, $X^1$ and $X^2$ each represent a carbonyl group or a sulfonyl group, and the above piperazine ring can have one or more substituents;

(3) a di-substituted diamide derivative of dicarboxylic acid having the formula (III),

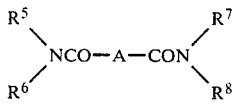

(III)

wherein $R^5$, $R^6$, $R^7$ and $R^8$ each represent a substituted or unsubstituted alkyl, cycloalkyl, aryl or aralkyl group, the combinations of $R^5$ and $R^6$, and $R^7$ and $R^8$, each can form a ring structure, and A represents an aliphatic group or an aromatic group;

(4) a piperazine derivative having the formula (IV),

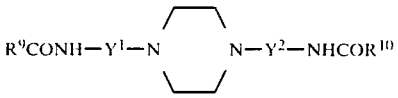

(IV)

wherein $R^9$ and $R^{10}$ each represent a substituted or unsubstituted alkyl, cycloalkyl, aryl or aralkyl group, $Y^1$ and $Y^2$ each represent a straight or branched alkylene group, and the above piperazine ring can have one or more substituents;

(5) a compound having three or more amide groups; and no tertiary amine groups and (6) a compound having two or more amide groups and one or more tertiary amine groups.

2. A two-color thermosensitive recording adhesive label as claimed in claim 1, wherein each alkyl group represented by $R^1$, $R^2$, $R^3$, $R^4$, $R^5$, $R^6$, $R^7$, $R^8$, $R^9$ and $R^{10}$ has 1 to 18 carbon atoms.

3. A two-color thermosensitive recording adhesive label as claimed in claim 1, wherein said aliphatic group represented by A in the formula (III) is an alkylene group having 1 to 8 carbon atoms.

4. A two-color thermosensitive recording adhesive label as claimed in claim 1, wherein said aromatic group represented by A in the formula (III) is an arylene group selected from the group consisting of unsubstituted or substituted phenylen, tolylene and xylylene, and the substituents thereof are selected from the group consisting of halogen, acylamino group, alkoxycarbonyl group, carbamoyl, aryoxy group and aralkyloxy group.

5. A two-color thermosensitive recording adhesive label as claimed in claim 1, wherein said alkylene group represented by $Y^1$ and $Y^2$ in the formula (IV) has 1 to 18 carbon atoms.

6. A two-color thermosensitive recording adhesive label as claimed in claim 1, wherein said substituted alkyl, cycloalkyl, aryl or aralkyl group represented by $R^1$, $R^2$, $R^3$, $R^4$, $R^5$, $R^6$, $R^7$, $R^8$, $R^9$ and $R^{10}$ have one or more substituents selected from the group consisting of alkyl group, aryl group, halogen, alkoxy group, aryloxy group, acyl group, acyloxy group, alkoxycarbonyl group, carbamoil group and acylamino group.

7. A two-color thermosensitive recording adhesive label as claimed in claim 1, wherein said piperazine ring have one or more substituents selected from the group consisting of alkyl group, aryl group, halogen, alkoxy group, aryloxy group, acyl group, acyloxy group, alkoxycarbonyl group, carbamoil group and acylamino group.

8. A two-color thermosensitive recording adhesive label as claimed in claim 1, wherein said piperazine derivative having the formula (I) is selected from the group consisting of:

N-methyl-N'-phenylacetylpiperazine,
N-propyl-N'-phenylacetylpiperazine,
N-propyl-N'-benzoylpiperazine,
N-butyl-N'-benzoylpiperazine,
N-cyclohexyl-N'-benzoylpiperazine,
N-hexyl-N'-benzoylpiperazine,
N-lauryl-N'-benzoylpiperazine,
N-stearyl-N'-benzoylpiperazine,
N-phenyl-N'-benzoylpiperazine,
N-benzyl-N'-benzoylpiperazine,
N-phenyl-N'-cyclohexyloylpiperazine,
N-phenyl-N'-acetylpiperazine, N-phenyl-N'-lauroylpiperazine,
N-phenyl-N'-p-methylbenzoylpiperazine,
N-phenyl-N'-p-chlorobenzoylpiperazine,
N-benzoylaminoethyl-N'-benzoylpiperazine,
N-benzoylaminopropyl-N'-benzoylpiperazine,
N-benzoylaminobutyl-N'-benzoylpiperazine,
N-benzoylaminopropyl-N'-cyclohexylpiperazine,
N-cyclohexyloylaminopropyl-N'-cyclohexyloylpiperazine,
N-benzoylaminoamyl-N'-benzoylpiperazine,
N-(p-chlorobenzoylaminoamyl)-N'-(chlorobenzoyl)-piperazine,
N-phenyl-N'-benzenesulfonylpiperazine,
N-benzyl-N'-benzenesulfonylpiperazine,
N-methyl-N'-benzenesulfonylpiperazine,
N-propyl-N'-benzenesulfonylpiperazine,
N-butyl-N'-benzenesulfonylpiperazine,
N-hexyl-N'-benzenesulfonylpiperazine,
N-cyclohexyl-N'-benzenesulfonylpiperazine,
N-lauryl-N'-benzenesulfonylpiperazine,
N-stearyl-N'-benzenesulfonylpiperazine,
N-phenyl-N'-butylsulfonylpiperazine,
N-phenyl-N'-laurylsulfonylpiperazine,
N-phenyl-N'-stearylsulfonylpiperazine,
N-phenyl-N'-cyclohexysulfonylpiperazine,
N-phenyl-N'-benzylsulfonylpiperazine,
N-phenyl-N'-(p-methylbenzenesulfonyl)piperazine,
N-butyl-N'-(p-methylbenzenesulfonyl)piperazine,
N-benzoylaminopropyl-N'-benzenesulfonylpiperazine,
N-benzoylaminopropyl-N'-p-methylbenzenesulfonyl-piperazine,
N-benzoylaminoethyl-N'-benzenesulfonylpiperazine,
N-benzoylaminobutyl-N'-benzenesulfonylpiperazine,
N-benzoylaminopropyl-N'-butanesulfonylpiperazine,
N-naphthoylaminopropyl-N'-benzenesulfonylpiperazine,
N-benzenesulfonylaminopropyl-N'-benzenesulfonyl-piperazine,
N-butyroylaminopropyl-N'-benzoylpiperazine,
N-hexyloylaminopropyl-N'-benzoylpiperazine,
N-lauroylaminopropyl-N'-benzoylpiperazine,
N-stearoylaminopropyl-N'-benzoylpiperazine, and
N-stearoylaminopropyl-N'-benzenesulfonylpiperazine.

9. A two-color thermosensitive recording adhesive label as claimed in claim 1, wherein said piperazine derivative having the formula (II) is selected from the group consisting of:
N,N'-bis(benzenesulfonyl)piperazine,
N,N'-bis(p-methylbenzenesulfonyl)piperazine,
N,N'-bis(p-isopropylbenzenesulfonyl)piperazine,
N,N'-bis(p-chlorobenzenesulfonyl)piperazine,
N,N'-bis(o-chlorobenzenesulfonyl)piperazine,
N,N'-bis(m-chlorobenzenesulfonyl)piperazine,
N,N'-bis(p-bromobenzenesulfonyl)piperazine,
N,N'-bis(butylsulfonyl)piperazine,
N,N'-bis(octylsulfonyl)piperazine,
N,N'-bis(laurylsulfonyl)piperazine,
N,N'-bis(stearylsulfonyl)piperazine,
N,N'-bis(cyclohexylsulfonyl)piperazine,
N,N'-bis(p-laurylbenzenesulfonyl)piperazine,
N,N'-bis(cyclohexylsulfonyl)piperazine,
N-butylsulfonyl-N'-benzenesulfonylpiperazine,
N-octylsulfonyl-N'-benzenesulfonylpiperazine,
N-(o-chlorobenzenesulfonyl)-N'-benzenesulfonyl-piperazine,
N-lauroyl-N'-benzenesulfonylpiperazine,
N-lauroyl-N'-(p-methylbenzenesulfonyl)piperazine,
N-benzoyl-N'-benzenesulfonylpiperazine,
N-(o-chlorobenzoyl)-N'-benzenesulfonylpiperazine,
N-(o-methylbenzoyl)-N'-benzenesulfonylpiperazine,
N,N'-bis(butyroyl)piperazine,
N,N'-bis(hexyloyl)piperazine,
N,N'-bis(tert-octyloyl)piperazine,
N,N'-bis(lauroyl)piperazine,
N,N'-bis(stearoyl)piperazine,
N,N'-bis(pivaloyl)piperazine,
N,N'-bis(cyclohexyloyl)piperazine,
N,N'-bis(p-methylcyclohexyloyl)piperazine,
N,N'-bis(p-methylphenylacetyl)piperazine,
N,N'-bis(phenylacetyl)piperazine,
N,N'-bis(phenylpropionyl)piperazine,
N,N'-bis(benzoyl)piperazine,
N,N'-bis(phenoxyacetyl)piperazine,
N,N'-bis(p-chlorobenzoyl)piperazine,
N,N'-bis(2-phenoxypropyonyl)piperazine,
N,N'-bis(m-chlorobenzoyl)piperazine,
N,N'-bis(o-chlorobenzoyl)piperazine,
N,N'-bis(p-methylbenzoyl)piperazine,
N,N'-bis(m-methylbenzoyl)piperazine,
N,N'-bis(o-methylbenzoyl)piperazine,
N,N'-bis(o-acetyloxybenzoyl)piperazine,
N,N'-bis(o-butyloxybenzoyl)piperazine,
N,N'-bis(p-phenylbenzoyl)piperazine,
N,N'-bis(p-methoxycarbonylbenzoyl)piperazine,
N,N'-bis(p-isopropoxycarbonylbenzoyl)piperazine, and
N,N'-bis(p-octadecylcarbamoylbenzoyl)piperazine.

10. A two-color thermosensitive recording adhesive label as claimed in claim 1, wherein said di-substituted diamide derivative of dicarboxylic acid having the formula (III) selected from the group consisting of:
N,N,N',N'-tetra-butylsuccinic acid diamide,
N,N,N',N'-tetra-octylsuccinic acid diamide,
N,N,N',N'-tetra-laurylsuccinic acid diamide,
N,N,N',N'-tetra-stearylsuccinic acid diamide,
N,N,N',N'-tetra-phenyladipic acid diamide,
N,N,N',N'-tetra-p-butylphenyladipic acid diamide,
N,N,N',N'-tetra-butyladipic acid diamide,
N,N,N',N'-tetra-octyladipic acid diamide,
N,N,N',N'-tetra-lauryladipc acid diamide,
N,N,N',N'-tetra-stearyladipic acid diamide,
N,N'-dicyclohexyl-N,N'-dimethylsuccinic acid diamide,
N,N'-dicyclohexyl-N,N'-dimethylglutaric acid diamide,
N,N'-dicyclohexyl-N,N'-dimethyladipic acid diamide,
N,N,N',N'-tetra-cyclohexyladipic acid diamide,
N,N'-dimethyl-N,N'-dicyclohexylsuberic acid diamide,
N,N'-dimethyl-N,N'-dicyclohexylsebacic acid diamide,
N,N'-dimethyl-N,N'-dicyclohexylmalonic acid diamide,
N,N,N',N'-tetra-benzyladipic acid diamide,
adipoyldipiperidine,
adipoyldipecoline,
adipoyl-di-ε-caprolactam,
adipoyl-di-pyrrolidone,
adipoyl-di-piperidone,
sebacoyl-di-ε-caprolactam,
sebacoyl-di-piperidine,
adipoyl-di-3-chloro-ε-caprolactam,
succinyl-di-3-chloro-ε-caprolactam,
N,N -terephthaloybispiperidine,
N,N'-isophthaloylbispiperidine,
N,N'-phthaloylbisperidine,
N,N'-terephthaloylbismorpholine,
N,N'-isophthaloylbismorpholine,
N,N'-phthaloylbismorpholine,
N,N'-terephthaloylbis-4-methylpiperazine, N,N'-isophthaloylbis-4-methylpiperazine,
N,N'-phthaloylbis-4-methylpiperazine,
N,N'-terephthaloylbis-4-phenylpiperazine,
N,N'-isophthaloylbis-4-phenylpiperazine,
N,N'-phthaloylbis-4-phenylpiperazine,
N,N'-terephthaloylbis-4-propylpiperazine,
N,N'-isophthaloylbis-4-propylpiperazine,
N,N'-phthaloyl-4-propylpiperazine,
N,N'-terephthaloylbiscaprolactam,
N,N'-isophthaloylbiscaprolactam,
N,N'-phthaloylbiscaprolactam,
N,N'-terephthaloylbis-3-chlorocaprolactam,
N,N'-isophthaloylbis-3-chlorocaprolactam,
N,N'-phthaloylbis-3-chlorocaprolactam,
N,N'-terephthaloylbisvalerolactam,
N,N'-isophthaloylbisvalerolactam,
N,N'-phthaloylbisvalerolactam,
N,N'-terephthaloylbispyrrolidine,
N,N'-isophthaloylbispyrrolidine,
N,N'-phthaloylbispyrrolidine,
N,N'-terephthaloylbis-diethylamine,
N,N'-isophthaloylbis-diethylamine,
N,N'-phthaloylbis-diethylamine,
N,N'-terephthaloylbis-dipropylamine,
N,N'-isophthaloylbis-dipropylamine,
N,N'-terephthaloylbis-dibutylamine,
N,N'-isophthaloylbis-dibutylamine,
N,N'-terephthaloylbis-cyclohexyl-methylamine,
N,N'-isophthaloylbiscyclohexyl-methylamine,
N,N'-terephthaloylbis-dicyclohexylamine,
N,N'-isophthaloylbis-dicyclohexylamine,
N,N'-terephthaloylbis-dibenzylamine,
N,N'-isophthaloylbis-dibenzylamine,
N,N'-terephthaloylbis-dioctylamine,
N,N'-isophthaloylbis-dioctylamine,
N,N'-terephthaloylbis-diethoxypropylamine,
N,N'-terephthaloylbis-4-chlorobutylamine,
N,N'-terephthaloylbis-dibenzoylaminoethylamine,
N,N'-isophthaloylbis-dibenzoylaminoethylamine,
N,N'-terephthaloylbis-benzoylaminopropylamine,
N,N'-isophthaloylbis-benzoylaminopropylamine,
N,N'-terephthaloylbis-diacetylaminoethylamine,
N,N'-isophthaloylbis-diacetylaminoethylamine,
N,N'-terephthaloylbis(4-methylpiperidine),
N,N'-terephthaloylbis(3-methylpiperidine),
N,N'-terephthaloylbis(3,5-dimethylpiperidine),
N,N'-terephthaloylbis(2-methylpiperidine),
N,N'-terephthaloylbis(2,6-dimethylpiperidine),
N,N'-isophthaloylbis(4-methylpiperidine),
N,N'-phthaloylbis(4-methylpiperidine),
N,N'-isophthaloylbis(3-methylpiperidine),
N,N'-phthaloylbis(3-methylpiperidine),
N,N'-isophthaloylbis(3,5-dimethylpiperidine),
N,N'-phthaloylbis(3,5-dimethylpiperidine),
N,N'-isophthaloylbis(2-methylpiperidine),
N,N'-phthaloylbis(2-methylpiperidine),
N,N'-isophthaloylbis(2,6-dimethylpiperidine),
N,N'-phthaloylbis(2,6-dimethylpiperidine),
N,N'-terephthaloylbis(4-benzylpiperidine),
N,N'-isophthaloylbis(4-benzylpiperidine),
N,N'-phthaloylbis(4-benzylpiperidine),
N,N'-terephthaloylbis(4-methoxycarbonylpiperidine),
N,N'-isophthaloylbis(4-methoxycarbonylpiperidine),
N,N'-terephthaloylbis(2-methoxycarbonylpiperidine),
N,N'-isophthaloylbis(2-methoxycarbonylpiperidine),
N,N'-phthaloylbis(2-methoxycarbonylpiperidine),
N,N'-terephthaloylbis(4-ethylpiperidine),
N,N'-terephthaloylbis(4-propylpiperidine),
N,N'-terephthaloylbis(4-butylpiperidine),
N,N'-isophthaloylbis(4-ethylpiperidine),
N,N'-isophthaloylbis(4-n-propylpiperidine),
N,N'-isophthaloylbis(4-butylpiperidine),
N,N'-phthaloylbis(4-ethylpiperidine),
N,N'-phthaloylbis(4-propylpiperidine),
N,N'-phthaloylbis(4-butylpiperidine),
N,N'-terephthaloylbis(3-hydroxymethylpiperidine),
N,N'-isophthaloylbis(3-hydroxymethylpiperidine),
N,N'-phthaloylbis(3-hydroxymethylpiperidine),
N,N'-terephthaloylbis(5-ethyl-2-methylpiperidine),
N,N'-isophthaloylbis(5-ethyl-2-methylpiperidine),
N,N'-phthaloylbis(5-ethyl-2-methylpiperidene),
N,N'-terephthaloylbis(N-ethyl-N'-cyclohexylamine),
N,N'-isophthaloylbis(N-ethyl-N'-cyclohexylamine),
N,N'-phthaloylbis(N-ethyl-N'-cyclohexylamine),
N,N'-terephthaloylbis(N-propyl-N'-cyclohexylamine),
N,N'-isophthaloylbis(N-propyl-N'-cyclohexylamine),
N,N'-phthaloylbis(N-propyl-N'-cyclohexylamine),
N,N'-terephthaloylbis(N-butyl-N'-cyclohexylamine),
N,N'-isophthaloylbis(N-butyl-N'-cyclohexylamine),
N,N'-phthaloylbis(N-butyl-N'-cyclohexylamine),
N,N'-terephthaloylbis(4-ethyloxymethylpiperidine),
N,N'-isophthaloylbis(4-ethyloxymethylpiperidine),
N,N'-terephthaloylbis(4-ethyloxyethylpiperidine),
N,N'-isophthaloylbis(4-ethyloxyethylpiperidine),
N,N'-terephthaloylbis(2-methoxyethylpiperidine),
N,N'-isophthaloylbis(2-methoxyethylpiperidine),
N,N'-terephthaloylbis(4-methoxyethylpiperidine),
N,N'-isophthaloylbis(4-methoxyethylpiperidine),
N,N'-terephthaloylbis(4-phenylpiperidine),
N,N'-isophthaloylbis(4-phenylpiperidine),
N,N'-phthaloylbis(4-phenylpiperidine),
N,N'-terephthaloylbis(4-phenylpropylpiperidine),
N,N'-isophthaloylbis(4-phenylpropylpiperidine), and
N,N'-phthaloylbis(4-phenylpropylpiperidine).

11. A two-color thermosensitive recording adhesive label as claimed in claim 1, wherein said piperazine derivative having the formula (IV) are selected from the group consisting of:

N,N'-bis(benzoylaminoethyl)piperazine,
N,N'-bis(benzoylaminopropyl)piperazine,
N,N'-bis(benzoylaminobutyl)piperazine,
N,N'-bis(cyclohexylaminopropyl)piperazine,
N,N'-bis(hexyloylaminopropyl)piperazine,
N-benzoylaminopropyl-N'-cyclohexylaminoethylpiperazine,
N-benzoylaminopropyl-N'-benzoylaminobutylpiperazine,
N-(p-chlorobenzoylaminoamyl)-N'-benzoylaminopropyl-piperazine,
N-cyclohexyloylaminopropyl-N'-cyclohexyloylaminobutyl-piperazine,
N-napthoylaminopropyl-N'-benzoylaminopropylpiperazine,
N-butyloylaminopropyl-N'-benzoylaminopropylpiperazine,
N-lauroylaminopropyl-N'-benzoylaminopropylpiperazine,
N-stearoylaminopropyl-N'-benzoylaminopropylpiperazine,
N-butyroylaminopropyl-N'-cyclohexyloylaminobutyl-piperazine,
N-naphthoylaminopropyl-N'-lauroylaminopropylpiperazine, and
N-naphthoylaminopropyl-N'-stearoylaminopropyl-piperazine.

12. A two-color thermosensitive recording adhesive label as claimed in claim 1, wherein said compound having three or more amide groups and no tertiary amine group and said compound having two or more amide groups and one or more tertiary amino groups are selected from the group consisting of:

N,N',N''-tribenzoyl-diethylenetriamine,
N,N',N''-tribenzoyl-dipropylenetriamine,
N,N',N'',N'''-tetrabenzoyl-triethylenetetramine, 1,7-dibenzoyl-4-methyl-diethylenetriamine, 1,9-dibenzoyl-5-methyl-dipropylenetriamine, 1,7-di-α-naphthoyl-4-methyl-diethyltriamine,
1,7-di-α-naphthoyl-4-cyclohexyl-diethylenetriamine,
N,N',N''-tripivaloyl-diethylenetriamine,
N,N',N'',N'''-tetraacetyl-triethylenetetramine,
N,N',N'',N'''-tetracyclohexyoyl-triethylenetetramine,
ethylenediamine tetra-acetic acid tetraanilide,
ethylenediamine tetra-acetic acid tetracycohexylamide,
ethylendiamine tetra-acetic acid tetra-2-ethylhexylamide,
ethylenediamine tetra-acetic acid tetralaurylamide,
ethylenediamine tetra-acetic acid tetrastearylamide,
ethylenediamine tetra-acetic acid tetrapiperidide, and
ethylenediamine tetra-acetic acid tetra-ε-capro-lactamide.

13. A two-color thermosensitive recording adhesive label as claimed in claim 1, wherein said leuco dye is selected from the group consisting of triphenylmethane-type leuco compounds, fluoran-type leuco compounds, pheno-thiazine-type leuco compounds, auramine-type leuco compounds, spiropyran-type leuco compounds and indolino-phthalide-type leuco compounds.

14. A two-color thermosensitive recording adhesive label as claimed in claim 1, wherein said decolorizing agent is contained in a decolorizing layer interposed between said first thermosensitive coloring layer and said second thermosensitive coloring layer, which decolorizing layer contains said decolorizing agent.

15. A two-color thermosensitive recording adhesive label as claimed in claim 14, further comprising an intermediate layer between said decolorizing layer and said first thermosensitive coloring layer.

16. A two-color thermosensitive recording adhesive label as claimed in claim 1, wherein said decolorizing agent is contained in said first thermosensitive coloring layer.

17. A two-color thermosensitive recording adhesive label as claimed in claim 16, further comprising an intermediate layer between said decolorizing layer and said second thermosensitive coloring layer.

18. A two-color thermosensitive recording adhesive label as claimed in claim 1, further comprising a protective layer on said second thermosensitive coloring layer for protecting developed images.

* * * * *